US008662985B2

(12) United States Patent
Johnson

(10) Patent No.: US 8,662,985 B2
(45) Date of Patent: Mar. 4, 2014

(54) ADDING SECONDARY GAME TO CONVENTIONAL GAMING MACHINES

(76) Inventor: Bradley W. Johnson, Henderson, NV (US)

( * ) Notice: Subject to any disclaimer, the term of this patent is extended or adjusted under 35 U.S.C. 154(b) by 1371 days.

(21) Appl. No.: 12/125,301

(22) Filed: May 22, 2008

(65) Prior Publication Data

US 2009/0191941 A1 Jul. 30, 2009

Related U.S. Application Data

(60) Provisional application No. 61/062,461, filed on Jan. 28, 2008.

(51) Int. Cl.
*A63F 9/24* (2006.01)
*G07F 17/32* (2006.01)

(52) U.S. Cl.
USPC ..... 463/20; 273/237; 463/25

(58) Field of Classification Search
CPC ..... G07F 17/32
See application file for complete search history.

(56) References Cited

U.S. PATENT DOCUMENTS 4,856,787 A * 8/1989 Itkis ..... 273/237
5,560,603 A 10/1996 Seelig et al.
5,664,998 A 9/1997 Seelig et al.
5,779,544 A 7/1998 Seelig et al.
5,976,015 A 11/1999 Seelig et al.
5,997,400 A 12/1999 Seelig et al.
6,224,486 B1 5/2001 Walker et al.
6,319,127 B1 11/2001 Walker et al.
6,908,390 B2 6/2005 Nguyen et al.
7,156,739 B2 1/2007 Walker et al.
7,311,604 B2 12/2007 Kaminkow et al.
7,317,774 B2 1/2008 Richey et al.
2002/0177483 A1 * 11/2002 Cannon ..... 463/42
2005/0026669 A1 * 2/2005 Nelson et al. ..... 463/16
2005/0043088 A1 2/2005 Nguyen
2005/0101384 A1 5/2005 Parham
2006/0009283 A1 1/2006 Englman et al.
2006/0111169 A1 * 5/2006 Hornik et al. ..... 463/16
2006/0111178 A1 * 5/2006 Gallaway et al. ..... 463/25
2006/0247012 A1 11/2006 Walker et al.
2007/0015572 A1 * 1/2007 Baerlocher ..... 463/25
2007/0060316 A1 3/2007 O'Halloran
2007/0111783 A1 * 5/2007 Cuddy et al. ..... 463/23
2008/0015006 A1 * 1/2008 George et al. ..... 463/17
2008/0039191 A1 * 2/2008 Cuddy ..... 463/25
2009/0191941 A1 * 7/2009 Johnson ..... 463/20
2009/0197684 A1 * 8/2009 Arezina et al. ..... 463/42
2009/0275389 A1 * 11/2009 Englman et al. ..... 463/20

* cited by examiner

*Primary Examiner* — Paul A D'Agostino
(74) *Attorney, Agent, or Firm* — Mollborn Patents, Inc.; Fredrik Mollborn

(57) ABSTRACT

Methods and apparatus, including computer program products, implementing and using techniques for providing a gaming apparatus. The gaming apparatus includes a primary display area, a wager data device, a secondary display area, and a controller. The wager data device receives wager data indicative of a wager submitted by a player. Results of the base game are displayed on the primary display area. Credits earned in the base game are converted to points in the secondary game. Results of the secondary game are displayed on the secondary display area while the base game is being played, in relation to predetermined point levels for each round of the secondary game. Based on the achieved point levels and the predetermined point levels for each round of the secondary game, it is determined whether to advance the player or to end the secondary game.

33 Claims, 13 Drawing Sheets

Championship Round

Grand Prize is $100,000

GAMES LEFT - 6

CURRENT POINTS – 13,245

| Place | Points | Prize |
|---|---|---|
| 34th | 14,678 | $256 |
| 35th | 14,100 | $210 |
| 36th | 13,678 | $185 |
| 37th | 13,245 | $130 |

FIG. 9

| Place | Points | Prize |
|---|---|---|
| 1st | 14,678 | Progressive |
| 2nd | 14,100 | $10,000 |
| 3rd | 13,678 | $1,000 |

FIG. 10A

| Place | Points | Prize |
|---|---|---|
| 1st | 14,678 | |
| 2nd | 14,100 | Progressive |
| 3rd | 13,678 | $10,000 |

FIG. 10B

Total Score Challenge

Sample Tournament Setup

| | |
|---|---|
| entry fee | $20 |
| people entering | 1,000,000 |
| total revenue | $20,000,000 |

| | advance | people | payback | total | avg. Payback |
|---|---|---|---|---|---|
| Round 1 | 50% | 500,000 | 10% | $2,000,000 | $4.00 |
| | | | | | |
| Round 2 | 50% | 250,000 | 7% | $1,400,000 | $5.60 |
| | | | | | |
| Round 3 | 50% | 125,000 | 8% | $1,600,000 | $12.80 |
| | | | | | |
| Championship Round | | 124,000 | 55% | $11,000,000 | $88.71 |
| | | | | | |
| Championship - first place | | 1 | 5% | $1,000,000 | $1,000,000.00 |
| | | | | | |
| Casino | | | 15% | $3,000,000 | |

| Round 1 | | Credits | Round 2 | Credits | Round 3 | Credits |
|---|---|---|---|---|---|---|
| prob | dollars | Paid | dollars | Paid | dollars | Paid |
| 0.083333333 | 2 | 40 | 3 | 60 | 8 | 160 |
| 0.083333333 | 2 | 40 | 3 | 60 | 8 | 160 |
| 0.083333333 | 2 | 40 | 3 | 60 | 9 | 180 |
| 0.083333333 | 2 | 40 | 3 | 60 | 9 | 180 |
| 0.083333333 | 2 | 40 | 3 | 60 | 10 | 200 |
| 0.083333333 | 2 | 40 | 4 | 80 | 10 | 200 |
| 0.083333333 | 3 | 60 | 4 | 80 | 12 | 240 |
| 0.083333333 | 3 | 60 | 4 | 80 | 12 | 240 |
| 0.083333333 | 5 | 100 | 5 | 100 | 15 | 300 |
| 0.083333333 | 5 | 100 | 10 | 200 | 15 | 300 |
| 0.083333333 | 10 | 200 | 10 | 200 | 20 | 400 |
| 0.083333333 | 10 | 200 | 15 | 300 | 25 | 500 |

FIG. 11

ADDING SECONDARY GAME TO CONVENTIONAL GAMING MACHINES

CROSS-REFERENCE TO RELATED APPLICATIONS

The present application claims priority under 35 U.S.C. 119(e) from U.S. Provisional Patent Application No. 61/062,461 entitled "TOTAL SCORE CHALLENGE—The method of adding a secondary game to regular slot machines" filed 28 Jan. 2008, the entire disclosure of which is incorporated herein by reference for all purposes.

BACKGROUND

This invention relates to gaming machines, such as slot machines and video poker machines. One of the major drawbacks experienced by slot machine or other gaming device players is that the player sometimes will win a few large jackpots on a game and then several hours later have lost all the money back to same slot machine or to other slot machines. The player receives no recognition for those wins. Most types of slot machines are designed for a casino to make money and for only a small percentage of players who play slot machines to walk away with more money than they started with. It is clear that players would enjoy getting rewarded if they do well on slot machines over a predetermined period of time, no matter how much the players lose. Many attempts have been made to create this experience. Some examples include: Casino Tournaments, and Player Tracking Bonuses.

Casino Tournaments—Casinos have been putting on tournaments for a long time. More recently, advances in technology also allow players to play games over computer networks, such as the Internet. Internet games and the ability to see the player's hold cards have drawn incredible interest. Players like to compete, while having a sense that that their skill will earn them more money than lesser skilled players. Players also like the social atmosphere of playing in tournaments. The main problem with tournaments is that they need to be scheduled and requires casino personnel to organize and run the tournaments, which does not work very well in a casino that is open 24 hours a day. Furthermore, the slot machines are not designed for tournament play so the game play is awkward. Also, while the games are being played during the tournament the games are not earning their normal revenue.

Player Tracking Bonuses—Casinos want to create loyal players who will continually visit their casino. As one way of achieving this, casinos aggressively advertise to players to sign up for the casinos' player clubs. Every time a player plays a slot machine with their player club card inserted in the machine the player receives "loyalty points," which can be redeemed for dinners, small gifts, cash back, free concert tickets, and so on. Some casinos give away large jackpots to player club members by randomly selecting players who are playing at slot machines with their player club card in the game. Other ways allow player club members to play bonus games on the small displays in the player tracking units. The problem with player tracking bonuses is that the bonuses run "behind the scenes" and are not really exciting to the player. Also prizes are awarded randomly versus being awarded based on performance so players never know if they will win.

SUMMARY

In general, in one aspect, the invention provides methods and apparatus, including computer program products, implementing and using techniques for providing a gaming apparatus. The gaming apparatus includes a primary display area, a wager data device, a secondary display area, and a controller. The primary display area displays a base game to a player. The wager data device receives wager data indicative of a wager submitted by the player. The secondary display area is separate from the primary display area and displays a secondary game to the player. The controller is operatively coupled to the primary display area, the wager data device, and the secondary display area. The controller includes a processor and a memory. The controller causes the following operations to occur. Results of the base game are displayed to the player on the primary display area. Credits earned in the base game are converted to points in the secondary game. Results of the secondary game are displayed to the player on the secondary display area while the base game is being played. The results are displayed in relation to predetermined point levels for each round of the secondary game. Based on the achieved point levels and the predetermined point levels for each round of the secondary game, it is determined whether to advance the player to a new round of the secondary game or to end the secondary game.

Advantageous implementations can include one or more of the following features. The controller can display a selection of secondary games to the player on the primary display area and receive a selection from the player of a secondary game to play. Displaying the selection of secondary games can include displaying a required entry fee for each of the secondary games, and receiving a selection can include receiving the required entry fee for the selected secondary game by the wager data device. A specific predetermined point level must be reached for the player in each round of the secondary game in order to advance the player to a new round of the secondary game. A player can have a specific number of base games to play in each round of the secondary game in order to advance the player to a new round of the secondary game. The last round of the secondary game can be a championship round, and point levels accumulated during the championship round can be used to determine a prize to be awarded to the player. The prize can be funded by a portion of entry fees received from players choosing to play the secondary game, and can be independent from wagers received from players for playing the base game.

The controller can display to the player a current point level in relation to established point levels based on the prize level configuration for the championship round. The prize can be a progressive top jackpot, a fixed jackpot, a moving jackpot, an elimination jackpots or a mystery jackpot. The controller can award a consolation prize to a player in response to determining not to advance the player to a new round of the secondary game. Any prize paid out from the secondary game can be based on a range or a targeted average pay. The gaming apparatus can be a video spinning reel slot machine, a mechanical spinning reel slot machine, a video poker slot machine, a video keno slot machine, a video blackjack slot machine, a live casino table game, an Internet casino game, a home video game or a handheld game.

Converting credits earned in the base game to points in the secondary game can be done in accordance with a predetermined formula. The controller can communicate with controllers located in other gaming apparatuses to enable community gaming versions, tournament gaming versions, team gaming versions, or player club gaming versions of the secondary game. The gaming apparatus can be operatively connected to a player tracking and accounting system, a game server, or a central monitoring system. The controller can download one or more of the base game and the secondary game from the game server prior to starting the base game or the secondary game. The controller can store the player's accumulated points for the secondary game in the player tracking and accounting system when a player ends the secondary game prior to reaching a championship or consolation round, so that the player can resume the secondary game at the point where the secondary game was ended at a later time.

In general, in another aspect, the invention provides methods and apparatus, including computer program products, implementing and using techniques for providing a community gaming system. The community game system includes several gaming apparatuses as described above and a common display operatively linked to the gaming The controller in each gaming apparatus communicates with controllers in other gaming apparatuses and with the common display in the community gaming system to achieve the following operations in the gaming system. One or more of: the achieved point levels for each player on each gaming apparatus, and the combined achieved points for all players on all the gaming apparatuses are displayed on the common display. Based on the combined achieved point levels and a predetermined combined point level for each round of the secondary game, it is determined whether to advance the group of players as a whole to a new round of the secondary game or to end the secondary game.

The invention can be implemented to include one or more of the following advantages. Players can play against predetermined point levels established by the secondary game software whenever they want and at any time they want. Any conventional gaming machine running a base game (e.g., video or mechanical spinning reel games, video poker, video keno, video blackjack, and to internet games, home video games, hand held games, and any other game where points or credits are awarded for play) can be customized to include a secondary game in accordance with various embodiments of the invention, which can be played simultaneously with the base game. This allows players to play their favorite base games, while at the same time having a chance at a large prize. While other games provide secondary games which can provide large jackpots, various implementations of this invention provide the opportunity for players to win on each game and at the same time win prizes for their overall performance while on a game. This may also increase the revenue of the gaming machine.

In contrast to existing additional games, the base game is not slowed down. Various embodiments allow for various types of jackpots, such as progressive jackpots, fixed jackpots, moving jackpots, elimination jackpots, and potentially mystery jackpots. Various embodiments of the invention can be run as a stand-alone or linked to a central system that enables community gaming, tournaments, teams, player clubs, and player tracking/accounting. Other embodiments can be a part of a downloadable gaming system or server based gaming, and a central monitoring system. Some embodiments can work with the internet or with a PC, or any other game engine type game. In most embodiments of this invention no new or unique hardware is required, but only custom software to run in the gaming machine or personal computer. A "competition" atmosphere, which a lot of players like, can be provided. For the casino, by adding a secondary game to current base games, the games may have renewed interest from the casino's clients and the life span of casino games may be extended on the casino floor.

The entry fee structure can vary. A player can pay an entry fee, or use player club points, or enter the game for free and have prizes paid from revenue from a base game. The various embodiments can also be run in demo mode or as a promotion where prizes are paid by the casino's marketing department. Based on the requirement to play a certain number of games and earn a certain number of points, the players may be encouraged to bet more money per game and/or play for a longer time on the base game than players normally do with standard slot machines. Players can be rewarded for past wins, in contrast to regular slot machine games where players can win credits then lose them in future games. Consolation Prizes can be offered when a player loses. The consolation prize can be a random amount of credits, which may be based, for example, on a range, targeted average pay, and what round the player lost in.

The players can earn points for the secondary game in a variety of ways and can see their point total go up and how close they are to qualifying for the next round. Some embodiments allow the player to see their points increase as well as the money they will win. The number of rounds, and also the number of games per round, can be anywhere from one to a very large number. The difficulty of qualifying for a championship round and winning prizes can be varied. Furthermore, to have the two different bets (short and long term) simultaneously going on at the same time offers a gaming experience that has not been available before in a casino.

The details of one or more embodiments of the invention are set forth in the accompanying drawings and the description below. Other features and advantages of the invention will be apparent from the description and drawings, and from the claims.

DESCRIPTION OF DRAWINGS

FIG. 9 shows a schematic view of a screen shot on a top box display for a championship round, in accordance with one embodiment of the invention.

FIGS. 10A-10B show schematic view of screen shots on top box displays with different award levels, in accordance with one embodiment of the invention.

FIG. 11 shows an exemplary breakdown of payouts in the consolation and championship rounds, in accordance with one embodiment of the invention.

Like reference symbols in the various drawings indicate like elements.

DETAILED DESCRIPTION

Overview

Figure 1:
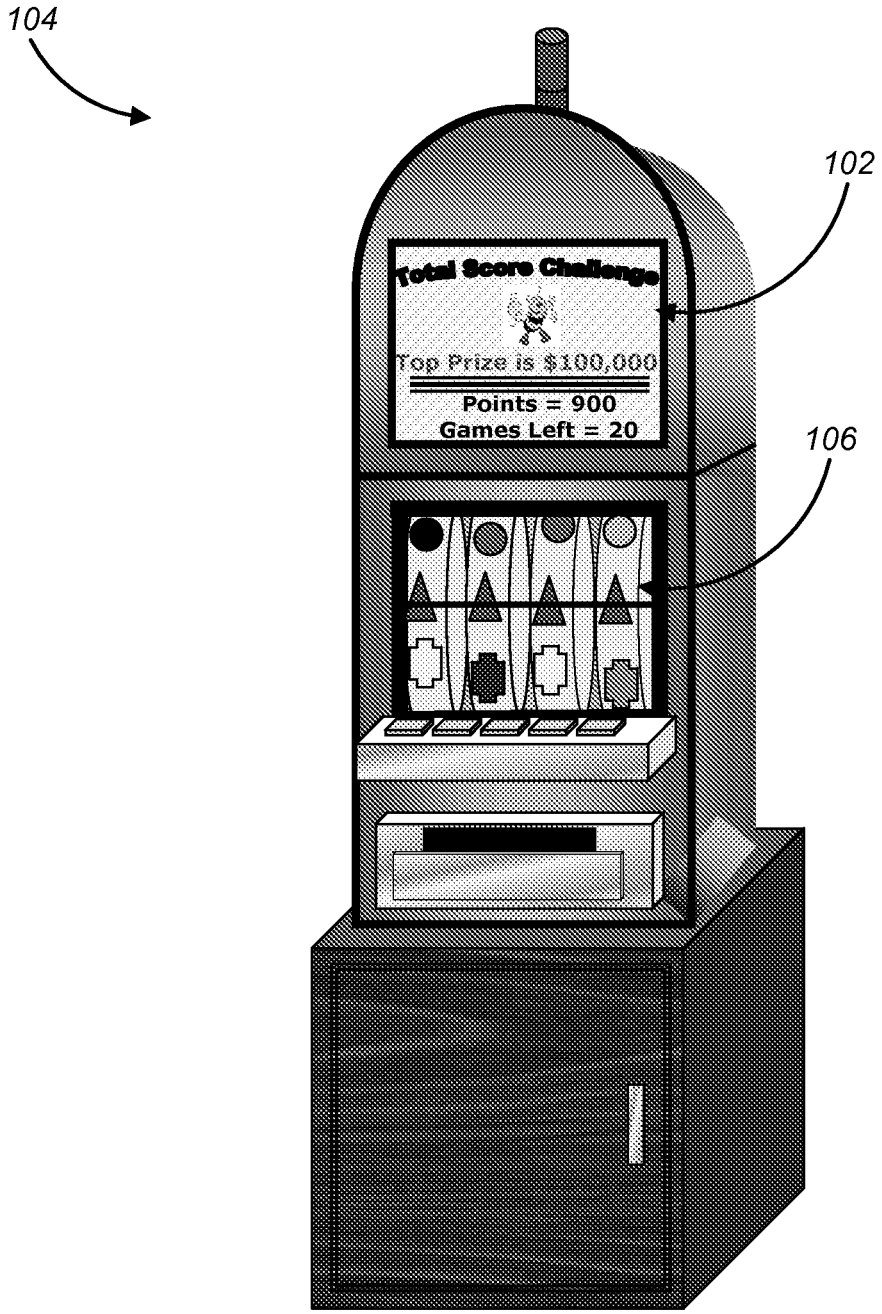
FIG. 1 shows a slot machine having spinning reels in a main cabinet and a display in a top box for running a secondary game, in accordance with one embodiment of the invention.

The various embodiments of the invention described herein pertain to enhancements to gaming machines, such as regular slot machines that are common in casinos throughout the world. In particular, a secondary game is integrated to the base game that is run on the gaming machine. The secondary game allows players to try to reach certain point levels over a predetermined number of games based on winning credits in the base game. This is in contrast to existing tournament-like environments where players can play against each other, typically at a certain location and a certain time only. In some embodiments, the objective is to gain enough points, established by the game software (as opposed to points established by other players), in each round to repeatedly move on to the next round, and eventually on to a championship round, in which the player can earn large awards. In some embodiments, losing players get a second chance to win a consolation prize in a consolation round.

Various embodiments of the invention will now be described by way of example and with reference to the drawings. It should be noted that although the examples below refer to casino gaming machines, the concepts described herein are applicable to any type of gaming consoles, or even Internet games, in which various types of credits or points can be collected. Thus, various modifications to the examples described herein will be readily apparent to those skilled in the art, and such modifications are intended to fall within the scope of the claims.

DEFINITIONS

The following terminology will be used throughout the remainder of this specification, and are presented here to ease the reading of the remainder of the specification.

Secondary Game—The term secondary game as used in this invention is used herein to refer to the various embodiments of the invention. The secondary game is being played at the same time with the base game (that is, in parallel with the base game), but at the same time the secondary game is reliant on the outcomes from each game within the base game.

Bonus Game—Bonus games are games related to a base game on a gaming machine, such as a slot machine. The time at which a bonus game can be played varies from base game to base game. Some bonus games can be played when the base game reaches a certain reel symbol or combination of reel symbols. Some bonus games can be played anytime the player wants to play a bonus game. Sometimes, players need to qualify through the base game to play the bonus game. Generally, bonus means getting something extra while playing the base game. For example, the player may win 20 free games, which is a bonus offered in the base game. The free games are then run automatically by the base game software. The player could also win a bonus so the base game play is interrupted and the video spinning reels disappear and are replaced by, for example, 20 boxes, and the player chooses one box for a bonus. That is, in contrast to secondary games, bonus games happen infrequently and at specific times, based on certain criteria occurring within, or separate from, the base game.

Gaming Machine or Gaming Device—A gaming machine is a machine found in casinos throughout the world where players bet money on each game they will play. The players will either lose or win money on each game. Typically, the gaming machine can take a variety of different forms of currency such as coins, tokens, bills, smart cards, tickets, coupons, credit cards, and so on.

Slot Tournament—A slot tournament is a playing event to which players are invited by a casino or they enter into. Slot machines with special tournament software are placed in a designated area of the casino, and the area is usually roped off. The players typically play a couple of rounds. The players who place in the top few places in the final round typically win small prizes. The player is not playing the base game for credits and throughout the tournament the players are competing only against other players.

Top box display—most gaming machines have a cabinet where the base game is played, such as a slot game on a slot machine. On the top of the cabinet is often what is referred to as a top box. The top box is typically bolted to the regular cabinet. In the top box, there can either be just decorative slot glass, or there can be a display, such as a liquid crystal display (LCD) with animations. In general, the top box display shows information such as the game name, game information, possibly a pay table, but the top box can also be used for secondary games and bonus games, as will be described in further detail below.

Server base and Downloadable Gaming—The casino industry is moving towards server based gaming and downloadable gaming, which works as follows. Either the player chooses a game from a menu, or casino personnel selects a game or several games for a gaming machine. The selected game or games are then sent from a central system to the designated gaming machine. The difference between the two is that while the player is playing a server based game, the game is residing at the central system. When playing a downloadable game, the game is residing at the gaming machine.

Base game or game—A conventional gaming machine typically has a spinning reel game or a poker game as the base game (often also referred to as the regular game). More modern slot machines can incorporate a bonus game with the base game. One game for example is one hand of draw poker on a video poker machine or one spin of the reels in a video reel game.

Community Gaming—The games on the machines are linked together, thus allowing players to play in a more social atmosphere. Sometimes, the players are competing for bonus prizes, sharing in prizes, or working as a team to win prizes.

Payback Percentage—In a regular spinning reel or poker game there is a payback percentage set in the game software to ensure that the casino makes money and that the player gets a certain percentage of the money they wager back over time. Typically, the payback percentage is calculated over an entire cycle of game play, which can be millions of plays.

Points and Point Levels—Points as used herein are credits won in the base game. Point levels are points displayed by the game software which is needed to either reach the next round or in the final round equal to a prize amount. Point levels are based on what percentage players you want to advance and in the final to win certain prize amounts. The formula is mainly based on what percentage of players you want to reach each of the point totals and how much you want to payout in prizes. The point totals are derived by analyzing the pay table of the base game.

Exemplary Embodiment

As was described above, the various embodiments of the invention relate to gaming machines, such as slot machines, capable of running a secondary game. FIG. 1 shows a slot machine (104) in accordance with one embodiment of the invention. The design and functionality of conventional slot machines are well known to those of ordinary skill in the art, so this description will primarily focus on the distinguishing features of the gaming machine (104) that makes it possible to run a secondary game in accordance with the various embodiments of the invention. The slot machine (104) runs a conventional base game (106), which is displayed in a primary display area and which can be any type of conventional game that is commonly played in casinos throughout the world. As can be seen in FIG. 1, the base game (106) in the primary display area on some slot machines (104) are spinning reels. The slot machine (104) has a secondary display area, illustrated in FIG. 1 as a top box display (102), such as a liquid crystal display (LCD), capable of displaying a secondary game to the user. It should be noted that in some embodiments, the primary and secondary display areas can be located in the same physical unit, such that the point totals and information for the secondary game can be shown, for example, in a pop-up window (i.e., secondary display area) on the main display (106) (i.e., primary display area), or in a picture in picture area. The primary and secondary display areas can also be shown on a large display visible to a large number of people in the casino, as will be described in further detail below.

In most embodiments, the base game (106) is displayed to the player on a separate display located in the main cabinet (e.g., when the base game is a video poker or video reel game). A touch screen button icon (see, for example, touch screen button icon (304) in FIG. 3) on the base game display (106) can be used by the player to indicate that he or she wishes to play the secondary game (102) along with the base game (106). Alternatively, a regular button on a player control panel can be used for the same purpose.

The rules of the secondary game (102) in accordance with some embodiments can be summarized as follows. The objective for the player to participate in the secondary game is to win enough credits within a predetermined number of games to advance to the next round, and finally into the championship round, where the player wants to win enough credits to win the largest prize possible. The player pays an entry fee, also referred to as a wager, to enter into the secondary game. Typically the entry fee or wager is received by a wager data device. The wager data device can include any device that can accept a wager from a customer, such as, a coin slot acceptor, a paper currency acceptor, a ticket reader/printer and a card reader and/or writer which can be used to input a wager to the gaming machine. As used herein, the term "wager" may encompass gaming tokens, coins, paper currency, ticket vouchers, credit or debit cards, and any other object representative of value.

The entry fee in most embodiments is good for all games within each round and for all rounds for which the player may qualify, whereas typical wagering is more about betting on each individual game. Once the player has paid the entry fee, the player is shown the number of points needed to qualify for the next round and the number of games they need to play within that round. For example the player may have 50 games to match or beat 1000 points to qualify for the next round. In some embodiments, players who do not qualify for the championship round may qualify for consolation prizes and win a random bonus. The player can be informed of the minimum betting requirements on the base game for the secondary game. The top prize in the secondary game is a fixed or progressive jackpot. It is important to understand that the base game is being played at the same time as the secondary game and that the secondary game points are being supplied by the credits won from the base game. And that the player is still winning and losing credits on the base game while the player is trying to accumulate as many points as possible to reach the established point levels in the secondary game. The point levels are benchmarks set by the game software which are used to allow only a certain percentage of players to qualify for the next round or championship around and allow only a certain percentage of players to win each of the prize amounts.

Figure 2:
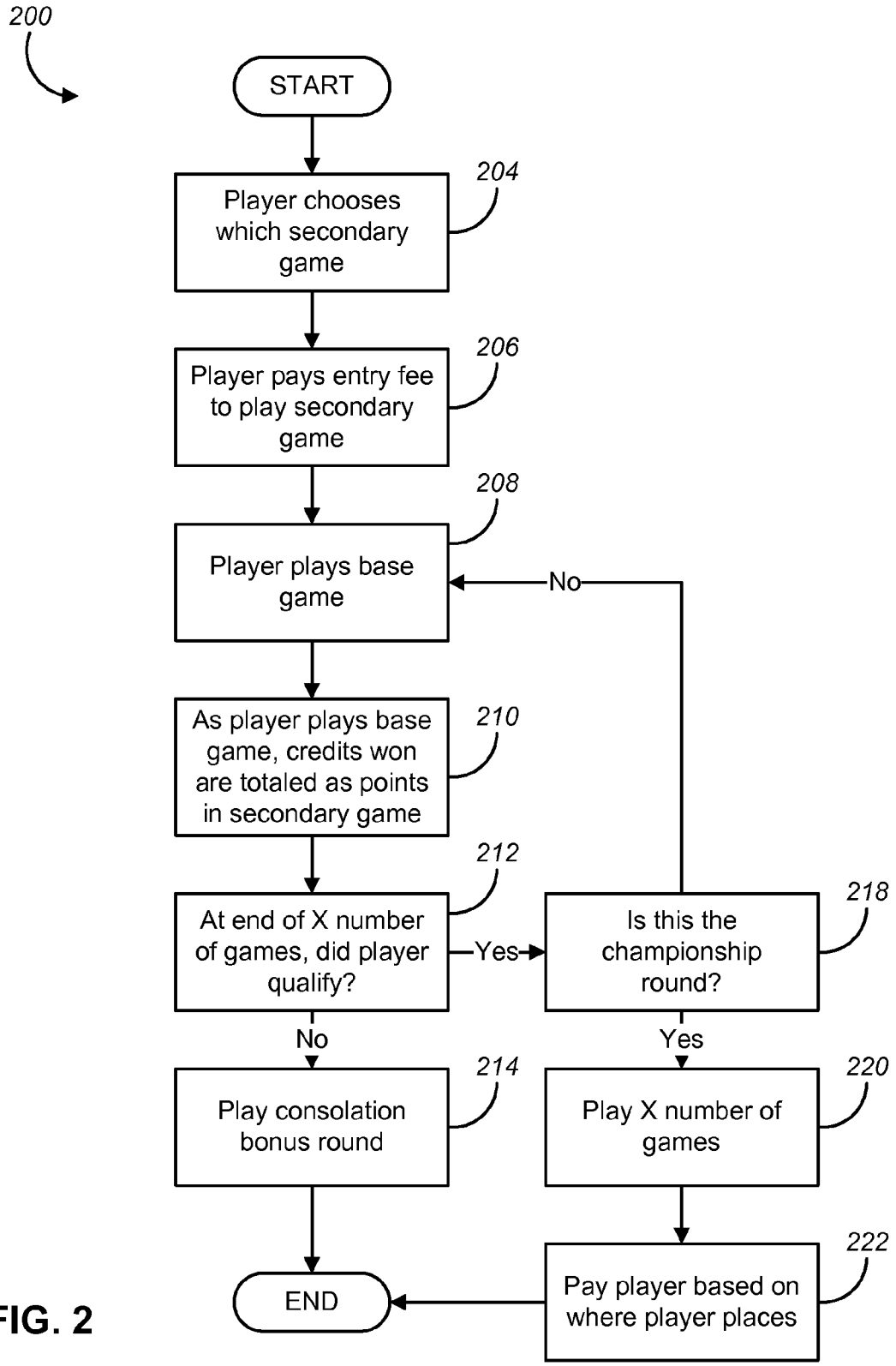
FIG. 2 shows a flowchart of how to play a secondary game, in accordance with one embodiment of the invention.
Figure 3:
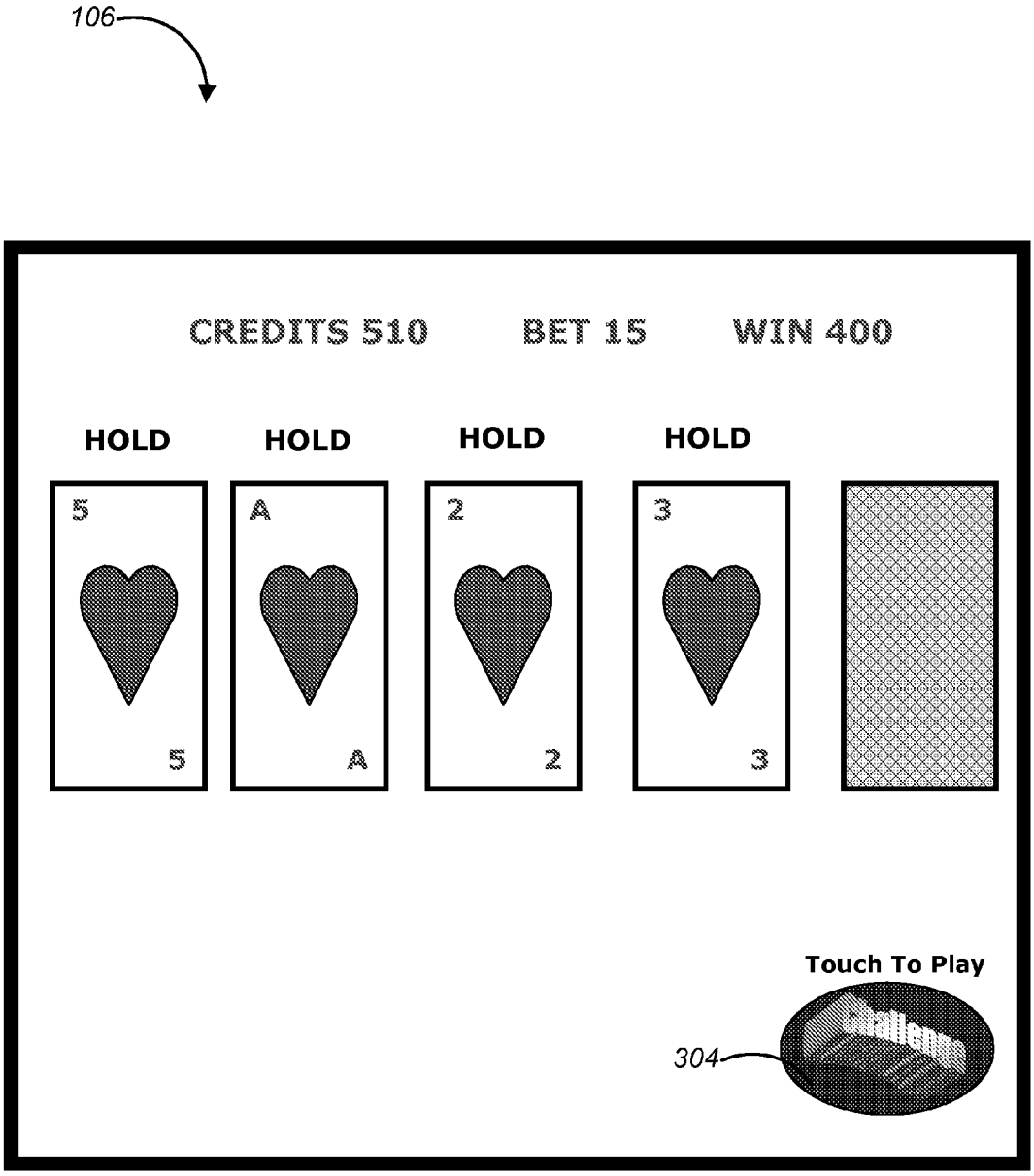
FIG. 3 shows a regular game (poker) display and a secondary game icon on the display that a player can select to play a secondary game, in accordance with one embodiment of the invention.

FIG. 2 shows a flowchart of how to play a secondary game, in accordance with one embodiment of the invention. As can be seen in FIG. 2, the player touches a secondary game touch screen button on a base game display (106), indicating that the player would like to participate in the secondary game (step 102). One example of such a touch screen button is shown in FIG. 3, which shows an exemplary base game display (106) with a base game (video poker) and a secondary game touch screen button (304) located in the lower right corner of the display (106). Of course, as the skilled person realizes, there is a wide range of ways in which the player can indicate a selection of a secondary game, and the touch screen button (304) in FIG. 3, is merely one of them.

Figure 4:
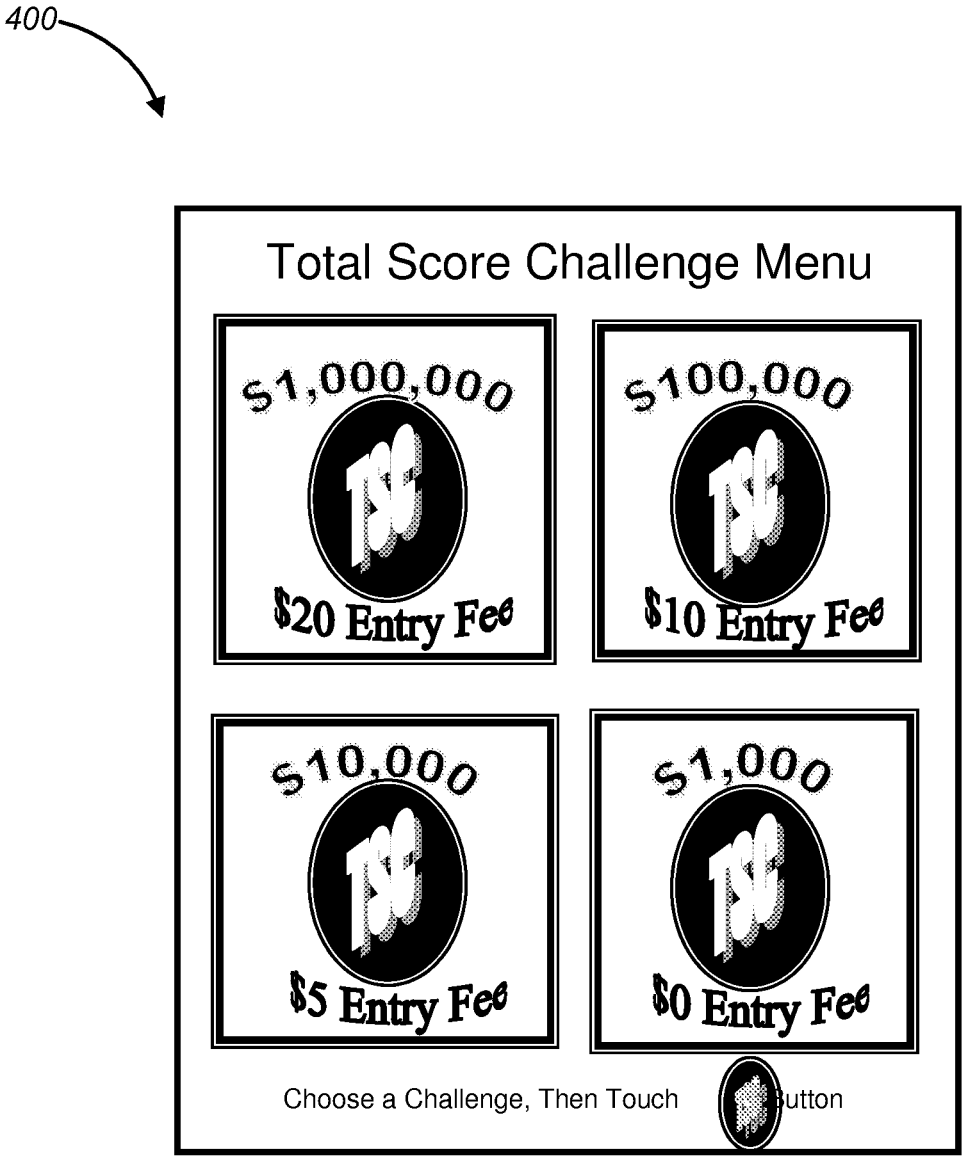
FIG. 4 shows a schematic view of a screen shot of a primary display with a menu of different types of secondary games available to a player, in accordance with one embodiment of the invention.

In response to the player selecting the touch screen button (304), a menu pops up showing different types of secondary games (102) available on the gaming machine (104). Some versions may provide the player with only one choice. Other versions may be free to the player. Others may have only one option, which is to pay an entry fee. Yet other versions may start out free to get the player use to the game and then switch to an entry fee. As the skilled reader realizes, there is a wide range of possibilities. FIG. 4 shows an example of a menu (400), which has four icons representing different secondary games and brief information associated with each secondary game to help the player to choose an appropriate secondary game.

Next, the player chooses a secondary game (102) by selecting the corresponding icon (step 204). This causes the rules and terms of the selected secondary game (102) to be displayed on the display. The player acknowledges that he as read and accepted the rules by clicking an OK button. The player is then requested to pay the entry fee to the secondary game (based on the fees that were shown when selecting the game, see FIG. 4) (step 206). Once the entry fee has been paid, the player continues to play the base game (step 208) in parallel with the secondary game (102) which is shown in on the top box display. Typically a welcome screen is shown on the top box display (102) with an animated "greeting" to get the player excited about the secondary game.

Figure 5:
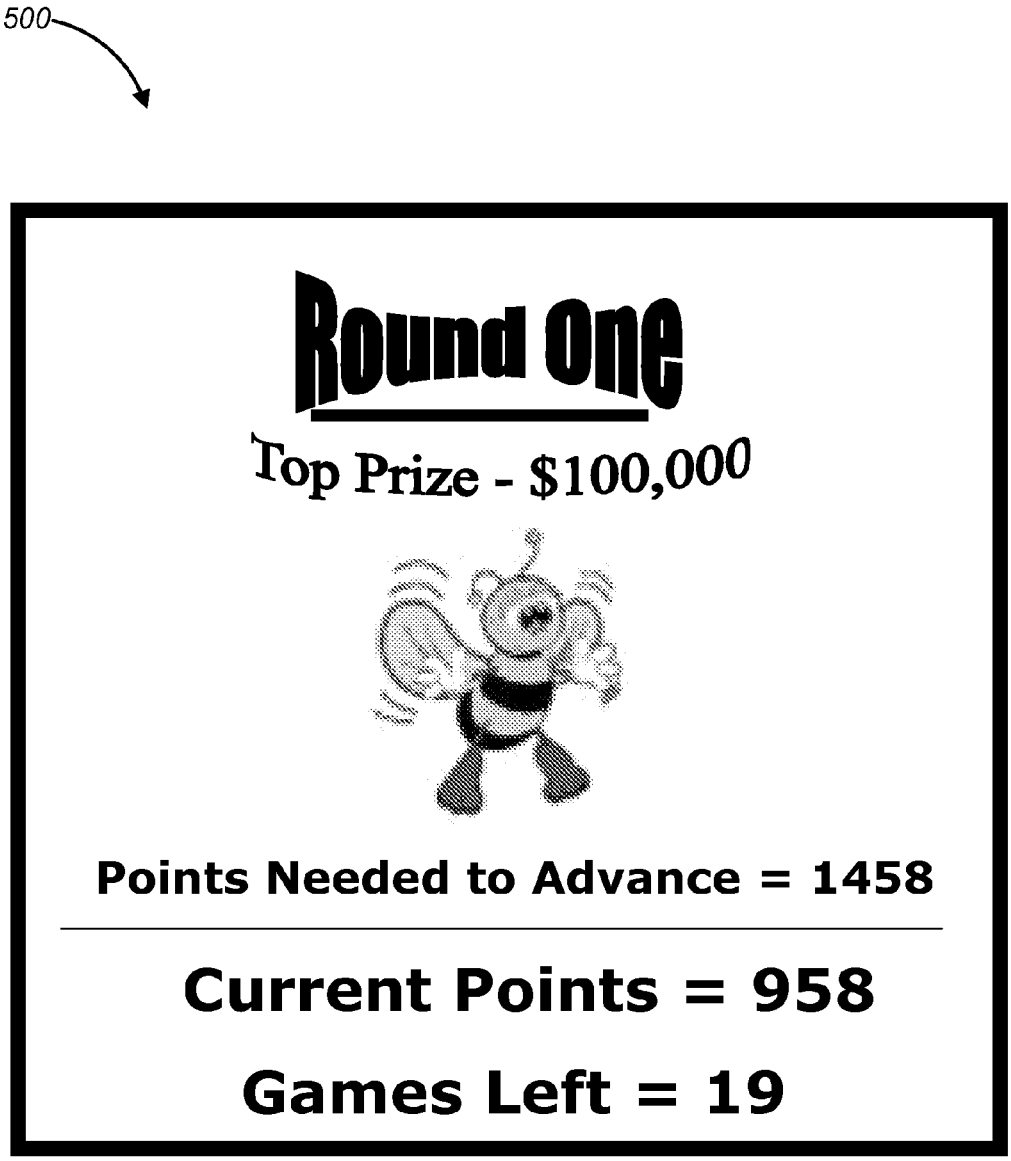
FIG. 5 shows a schematic view of a screen shot on a top box display for a player playing the first round in accordance with one embodiment of the invention.

As the player wins credits on the base game, the credits are totaled as points and added to a total points meter (step 210). While the base game is played, the secondary game shows continuous status updates to the player, informing the player about her current number of points, how many games are left, how many points are needed to advance to the next round, and so on. One example of such an update screen (500) is shown in FIG. 5.

Figure 6:
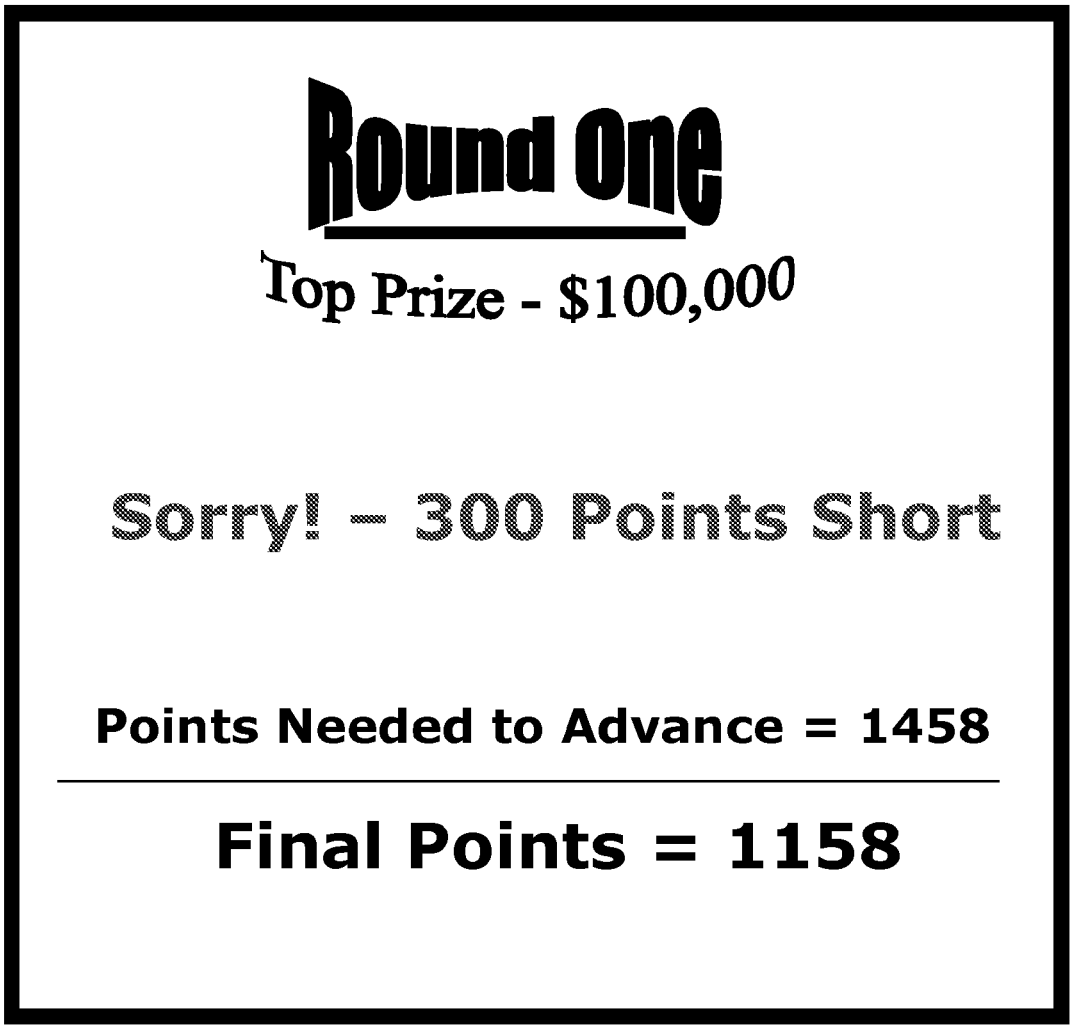
FIG. 6 shows a schematic view of a screen shot on a top box display for a player that failed get enough points in one of the rounds, in accordance with one embodiment of the invention.
Figure 7:
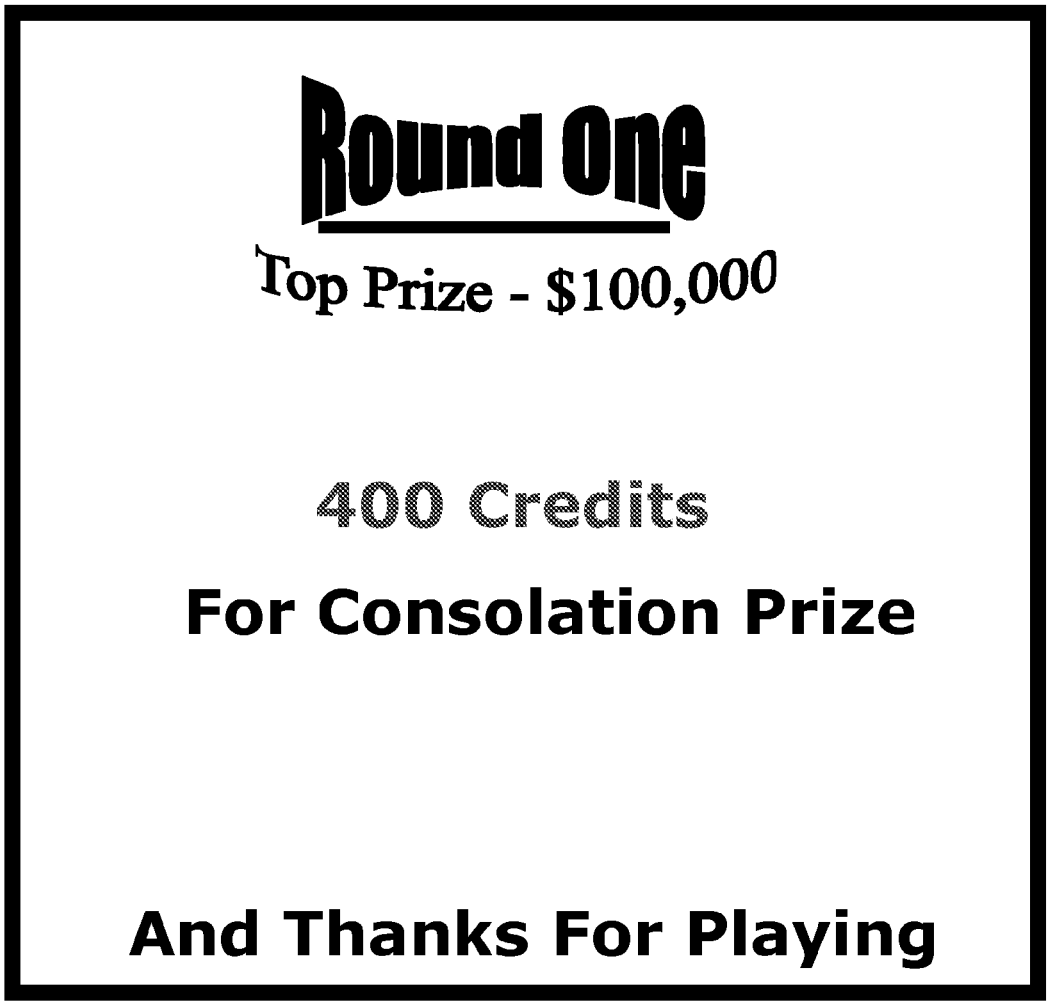
FIG. 7 shows a schematic view of a screen shot on a top box display for a player that failed to advance to the next round, but qualified for a consolation prize, in accordance with one embodiment of the invention.
Figure 8:
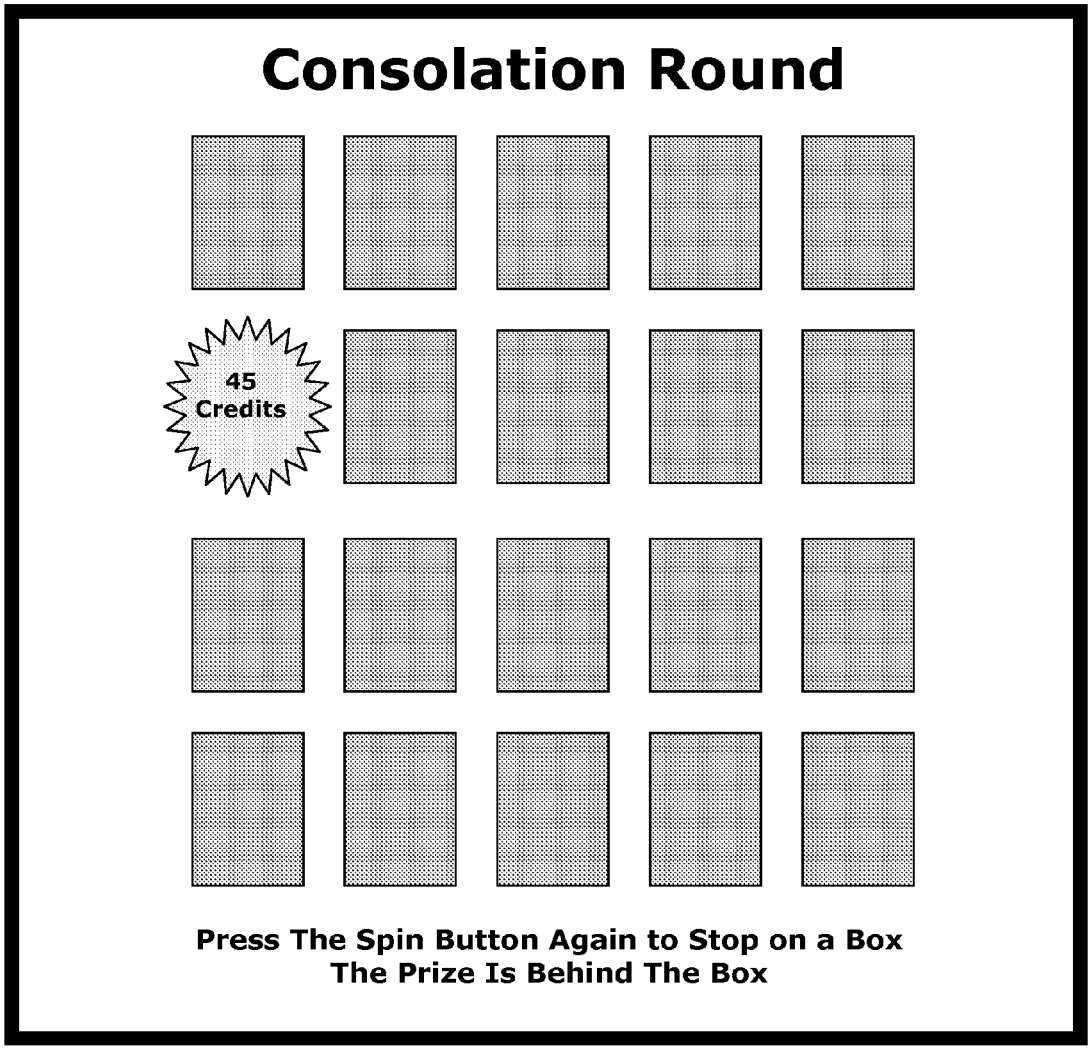
FIG. 8 shows a schematic view of a screen shot on a top box display with a consolation game, in accordance with one embodiment of the invention.

Once the player finishes the first round, the player will either have qualified for the next round or for a consolation bonus round (step 212). FIG. 6 shows a screen informing the player that he did not qualify for the next round. The player can then either be shown just a random number of credits for the consolation prize, as shown in FIG. 7, or can play a consolation round. The consolation rounds can include a wide variety of different types of fun methods of awarding a random prize. One example is shown in FIG. 8, where the player gets to choose one box from a group of 20 boxes. In this embodiment, the consolation game is done on the main cabinet display (106). Once a box is selected, the box flips over and awards a prize hidden behind the box is revealed as a consolation prize, e.g., 45 credits, as shown in FIG. 8. Consolation prizes can be shown on the top box display (102) in other embodiments, where the game software chooses the consolation prize for the player with no input from the player. This ends the secondary game. Typically, the consolation prize range gets larger as the player qualifies for higher rounds.

If it is determined in step 212 that the player qualifies for the next round, the player's points meter is reset to zero and the games meter is set to the number of games the player has to play to reach the predetermined point total The game then continues as described above with respect to step 208. Similar to the first round, the player needs to get a predetermined number of points to make it to the next round. Each subsequent round works in this way, until it is determined that the player has reached the final or championship round in step 218.

When it is determined that the championship round has been reached (step 218), the championship round starts (step 220). The championship round is different than the previous rounds in that every player who qualifies is guaranteed to finish in a place and win a cash prize. The player starts the championship round in the last place and as the player gains points, she moves up to higher places. For example, the last place can be place number 100 and the player may start with zero points, and when the championship round is finished, the player may have moved up to place number 52 with a total of 900 points. Similar to the regular rounds, the player continually sees the status of his place, number of points, prizes, number of games left, and so on, as can be seen in FIG. 9. Every place in the final round corresponds to a cash prize. The cash prize can, for example, be a progressive prize or a large fixed prize. The final winnings can then be sent to the player's credit meter or be paid out by casino personnel, similar to conventional game winnings.

Alternative Game Type Embodiments

As the skilled person realizes, various embodiments of the invention can be adapted to play as secondary games on any of the following types of base games, as well as on any other game where points or credits are won or scored by the player.

Video poker slot machine—The player, as part of the secondary game, plays the poker game, and each time the player wins a hand those credits won are then converted into points. This is for example show in FIG. 3.

Bartop poker games—Similar to video poker slot machines, these games are used in bars and are placed into the bar itself. The bartop poker game plays like regular video poker slot machines that stand upright. The only difference is the bar environment, where the bar has some type of promotion, for example, where the highest four of kind for the day or week wins an extra progressive or fixed prize. This encourages players to visit the casino's bar and rewards the players for gambling there. Various embodiments of this invention can be used in the bar for the player who gets the most points in the Championship round for the day, week or month can get an extra bonus. The points can be shown on a nearby display, showing the players what the point totals are needed to win. Alternatively, the point totals and secondary info can be shown in a pop-up window on the main display or a picture in picture area or linked to one large display that everyone can see.

Mechanical spinning reel slot machine—This works just like the video spinning reel games, except there is no display for the base game and the reels are actual reels (i.e., not animated reels), and to become part of the secondary game, the player reviews information given on the top box display and then pushes the proper buttons on the control panel for the player to participate in the secondary game. There could also be a small display screen in the cabinet that is near the mechanical reels that the player can interact with as far as entering into the secondary game.

Video Keno slot machine—The player plays video keno and either gets points for credits earned, or wins points for each correct number chosen.

Bingo and electronic bingo—The player gets points for the number of correct numbers the player gets on each card, and for example if a player plays 20 cards, the player then matches their point totals to established point totals to see if they won a prize.

Video Blackjack slot machine—Again as the player won the game and received credits, the credits would be converted into points for the secondary game.

Live casino table games—Live table games are found in casinos such as blackjack, roulette, craps, pai gow, baccarat, along with a variety of other games. Many of these games have been around a long time and are now being upgraded with electronics to make the games more exciting. For example, some live table games are using electronics to keep track of wins and the amount bet. Any live table game where the game play is being played through some kind of electronic means and results are tracked electronically can be upgraded to include various embodiments of the invention described herein.

Internet casino games—Currently on the Internet there are many websites at which a player can play casino style games. Various embodiments of the invention can be adapted to provide the same experience of the secondary game as found on a conventional slot machine. The winnings can be distributed to the player, for example, by money being sent to the player, or being credited to an account for the player, or a prize being sent to the player, or by various other methods. The prizes can be money or non-monetary prizes, such as gifts. The point totals and secondary info could be shown in a pop-up window on the main display or a picture in picture area or linked to one large display that everyone can see.

Home Video Games—Many companies have developed casino style games that can be played at home. Instead of competing for prizes, these types of games would reward bonus points. For those games played on the internet or at home on a PC or TV and not played for money or prizes, the excitement is reaching the highest number of rounds, and getting the highest number of points in the championship round. Those with high rounds could enter their names next to point total. The point total could be used as bonus points to be added on to the player's regular game total.

Handheld Games—Handheld devices can be used to play casino style games. Currently these types of games are very popular and allow people to play games while being on the go.

Figure 13:
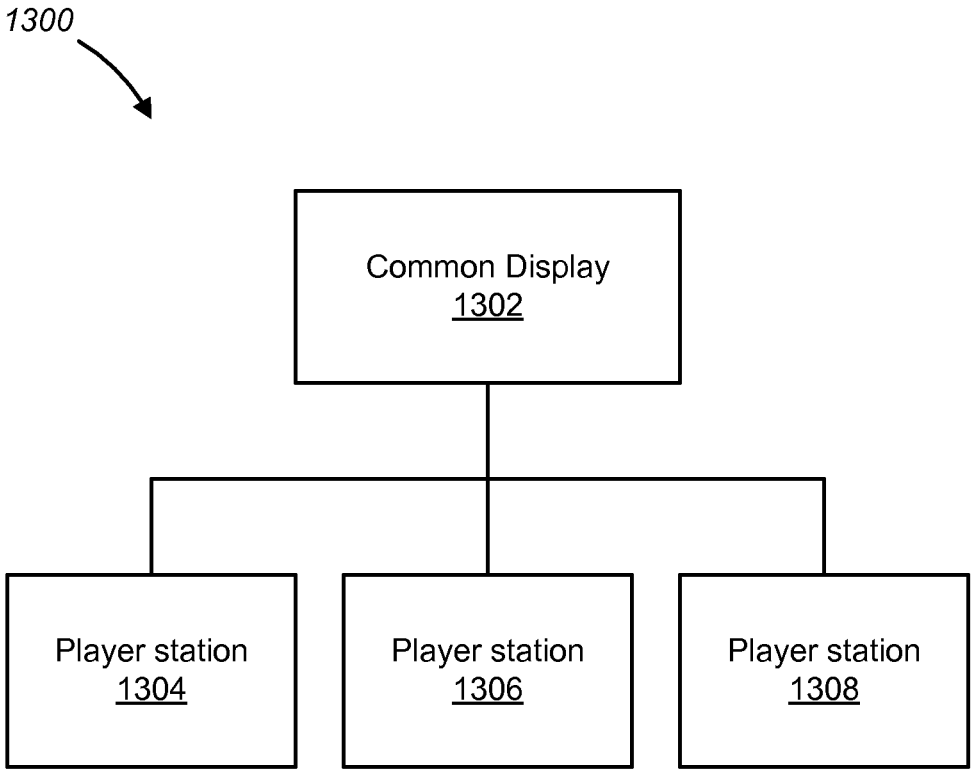
FIG. 13 shows a schematic overview of a community gaming system, in accordance with one embodiment of the invention.

Community Games—Sometimes multiple player stations (for example, 3-7 player stations) are linked to one common display. One such community game setup (1300) is schematically illustrated in FIG. 13. Each player plays their own base game, winning and losing credits, on their player station (1304; 1306; 1308), similar to traditional gaming machines. A large display (1302) in front of all the players shows how the individuals and the group as a whole are doing, and the objective is typically for the players at the player stations to reach a predetermined number of points as a group in a predetermined number of games. Thus, the machine counts down from predetermined number games and as players win credits, and the credits are added up and shown on the screen (1302). There is a predetermined point level that needs to be reached to make it into the bonus, the number of points the players go past the predetermined point level decides how much of the bonus the players will win. Individual players will get a percentage of the bonus based on how many credits the player contributed to the total.

For example, assume that four players are playing this version. They have 100 games to reach 10,000 points. So after each player has played 10 games, that means 40 games have been played and there are 60 games left. In those 40 games the players have scored 4,000 credits. At the end of the 100 games, the four players totaled up 14,000 points. Once the score went past 10,000 points, the players will seem how much they have won. The 4,000 could be equal to 1,500 bonus credits. If player station one contributed 50% of the points, it would get 750 credits.

In some embodiments, only those players that provide points before they reach the designated point level qualify for the bonus. Players who join the bonus late and start playing and winning credits will have their games and credits counted for the next secondary game challenge event.

In some embodiments, the championship round can be different than other versions in order to adapt the payouts to the unique circumstances of community gaming. For example, the group of players needs to reach 10,000 points in 100 games to make it to the championship round. Once they qualify, they will have 50 games to earn as many points as they can, each total will fall within a prize range. The more points, the higher the range, the larger the jackpots that will be divided between the participating players. It should be noted that community gaming can be played by one player and that one player can get into the bonus and win a prize. Other players may have contributed but they might have walked away before the group qualified for a bonus. There may be an idle limit so if a player station hasn't been played in the last 60 seconds, that station may not be part of the payoff.

Alternative Game Versions Embodiments

As the skilled person realizes, the secondary game described above can be played in many versions. Some of these versions will now be described in the following list, which merely provides a few examples of the full range of available game versions.

Tournament Version—in the tournament version, the base game does not pay out credits to players on each game, but only for points for the secondary game. The player does not bet money on each game, but only pays an entry fee for a predetermined number of games in the first round. During the conventional rounds, the player is not playing against other players but still against point levels. However, in the championship round the player can play against point levels or against other players. Thus, if various embodiments of this invention are being played on thousands of machines, then the prizes for the championship round, which could be played in front of an audience, could be for very large prizes. That is, various embodiments of this invention allows for an ongoing tournament since the secondary game can be played 24/7 in a casino. For example the championship round could be played every Saturday so those player qualifying during the week would show up on the upcoming Saturday. Those that qualify after the cutoff time would play in the Championship round the following Saturday. This is in contrast to regular slot tournaments, which need to have casino personnel present to administer the tournaments.

Player Club Only Version—The secondary game can be part of a loyalty program, where only players of a players' club or players in some kind of casino or internet membership can participate in the secondary game. For example, the player may need to use player club points or it can be a free promotion for players to play the secondary game. This also makes it possible for the casino to do promotions, where if the players come on a Tuesday night, say, all tournament play is free for player club members. This also enables the casinos to have promotions where a casino could announce, either over the Public Address (PA) system, or on the game itself, for example, that the next hour's players can play the tournament with free entry (even though they need to pay for the base game). The secondary game is shown on the small display located in the player tracking unit.

Server Based or Downloadable Version—The games can be linked throughout a casino, be a part of downloadable gaming or server based gaming system or network. The secondary game can reside on servers at a central system, and players can elect to participate in the secondary game. Once the player has made a selection, the secondary game is sent to the player's gaming machine from the central system. This also enables the casinos to have promotions where a casino could announce, either over the Public Address (PA) system, or on the game itself, for example, that the next hour's players can play the tournament with free entry (even though they need to pay for the base game).

Demo or Free Versions—The secondary game can be run as a demonstration or for free on the gaming machine. Instead of the player having to pay an entry fee to participate in the secondary game, the player can play just for fun to see how she would do and learn how the secondary game works. Prizes could also be won which would be funded through the base game revenue or from the slot marketing budget.

Entry Fee Only Version—This version is being played like any other game on the casino floor except that players are not playing the base game for credits but rather they are playing for their results in the secondary game. Games can be created just for the secondary game. The player pays an entry fee for the secondary game and the underlying game does not pay money back to the player. The player just plays the predetermined number of games, and based on the number of points at the end of each round, the player may advance to the next round. The player, by paying the entry fee, is given a predetermined number of games to play in each round. Since the player is given points for each game and is not winning money for each game, the games could be skill based games, where the players can be better than other players based on practice or intelligence. The base games can also be the same as current games, except the revenue is only made through entry fees. The player is not paid per game but instead based on how many points the player accrues over many games. Point levels can be set sufficiently high to allow only a certain percentage of the players to still win prizes.

Team Version—Many couples come to casinos but usually do not have slot games they can play with each other or play against each other. This is why live table games are popular in that you can play with other people at the same table. The secondary game can be installed on a slot machine designed where each player plays their own game but the credits are combined for the secondary game. Another version has the players playing their own games, but playing against each other. The higher score between the two after a predetermined number of games moves into round two. With server based gaming, players in different areas of the casinos or in different casinos could play against each other or with each other.

Further Game Features

As the skilled reader realizes, there are many other variations that can be made as well. For example, various embodiments can have various entry fee structures, such as the player paying a one time secondary game wager before the first round. Other versions can have the player paying an entry before each round. The entry fee can be essentially as high or as low as the provider of the secondary game wishes. The player can use a predetermined number of player club points from their account. A percentage of the money wagered by the player on the base game can be set aside for the secondary game.

The number of rounds in various embodiments can vary from one to a very large number. The number of games that the player is required to play during each round can vary from one to a very large number.

In some embodiments, gaming machines, such as slot machines, can have a version of the secondary game where the player has a menu that allows the player to pick different secondary games. The difference between the secondary games can be, for example, entry fees and prize money. For example, one choice can be a $20 entry fee with a $100,000 top award. A second choice can be $10 entry fee with a $25,000 top award. A third choice can be $5 entry fee with $10,000 top award, and a fourth choice can be a free entry with a $2,500 top award.

The number of points needed to reach certain prize levels in the championship round can be changed from one game to another and from one version to the next. The points needed each round to qualify for the next round can be any number configured by the game designer. The point levels are usually set based on a number of factors.

Each secondary game can be ongoing. One version can have a predetermined finished time such as when the top prize is finally won, especially if the top prize is a large progressive prize, and then the prize can be reset and started again. Some casinos may want short term top prizes, such as sports car as top prize, which after won may be switched back to progressive or fixed jackpot.

Instead of having a one-to-one correspondence between credits and points, different embodiments can provide a multiplier amount for each credit won. For example, with a 5× multiplier, the player can win 10 credits which are converted to 50 points. In some embodiments, the player can be awarded a number of points based on the number of credits won, divided by the number of credits played. For example, if the player wins 100 credits with 5 credits played, the player is awarded 20 points. The player can win a random number of points each time the player wins a game on the regular game. For example the player wins 20 credits on the base game, the secondary game then randomly awards the player 75 points. The next time the player wins a game on the base game the player gets a random 50 points. The player must still reach certain predetermined levels. The player can get points for just playing a game. The points could be fixed or random. The player can get a predetermined or random number of points for each game they lose. Points for the secondary game could be gained by putting numbers on the reels. Any number that falls under the pay line can be sent to the secondary game. The numbers represent points in the secondary game.

In some embodiments, if the player leaves during the middle of a round, the player can get a ticket from a ticket printer. The player can then, at a later time, insert the ticket into a ticket acceptor on a gaming machine and the secondary game resumes at the point where the secondary was before the player left. On the Internet or for Home Games the player can instead receive a game number to type in when the player wants to resume play. The secondary game results can game be recorded with their player club card number and they resume by inserting their player club card.

In some embodiments, the player can stop playing the secondary game in the middle of the round and then resume play on a different game. In one embodiment, the player must play the same type of base game with the same pay table on gaming machine that is equipped to run the secondary game. In one embodiment, each game divides the number of coins played by the number of credits won, so that each is gaining points based amount won on a one coin bet. In one embodiment, if the player moves on to another base game, no matter what the previous game was, the player must meet the new requirements of the new game. In one embodiment, the points of the previous game adjust to match the currents game's pay table. This can cause the points brought over to increase or decrease, which can be achieved by creating a conversion formula that analyzes the pay table of the previous game and then adapts to the current game's pay table.

In some embodiments, as the player plays the base game, the system can offer reference points to let the player know how many points they have, based on the number of games played. This lets the player know if the player is on track to reach the predetermined point total needed to advance to the next round. For example, assume that the player is required to play 50 games in the first round to reach 1000 points. The player starts out the first game with zero points and the reference point total is also zero. In the next game, the player has 10 points, and the reference point total is 20 points, which means that the player is below where he should be in order to reach the predetermined point total. In the third game, the player wins 50 points, bringing him up to a total of 60 points. However, the reference point total after game three is only 40 points. Thus, the player is now ahead of where he should be, and so on. The system can generate messages based on where the player's point total is during the round. For example, the system can tell the player that he is doing well and is ahead on points, or that he is falling behind and that he will need a big win soon, and so on.

Marketing Opportunities

In addition to the features discussed above, various embodiments of the secondary game may provide further advantages in terms of product branding and marketing opportunities, for example, for casinos that host the secondary game, as will be discussed in this section.

Various marketing features can be included that are used to draw players to the games. For example, the secondary game can have sponsors of the competition, such that in the top box display (102), there is advertising informing the player about who is sponsoring the competition. Famous movie or TV shows, or famous actors, musicians, athletes, and so on can be used for branding the secondary game so that players at a casino can see the branding and be drawn to the game.

Various types of media systems can be integrated with the secondary game to draw attention to the games. For example, pre-recorded video clips of a professional announcer can be shown and heard in the top box display (102) to make the secondary game more exciting as the player is playing and to attract players. Various types of sounds can be used to signify that the player has increased points and/or made it to the next round, or for various other reasons. Video clips from movies or TV shows can also be integrated into the secondary game in order to create different themes.

Instead of the player playing all the rounds at the game whenever they want, some versions could allow for the player to return to the casino on a specific date and time to play the final round in a public format where others would be watching, for example as part of a marketing promotion.

Once the player has made it to the championship round, the ticket printer can print a ticket that informs the player about when and where the championship round is held. The ticket can be used as an invitation, proof of qualifying, and as a reference number. As the skilled person realizes, there can be many versions of this. For example, for players who qualify for the championship round, instead of being played anytime the player wants the championship round can be played everyday at a specified time, or once a week, or once a month, or once a year, and so on. Once the player has qualified for the championship round, the player can choose to get a fixed prize or return on a specific date and play for a large jackpot. For example the player can receive $50 for making the championship round or be invited return at the end of the month to play the last round for a chance of $50 to $25,000.

The information about the secondary game can be shown on the display in the top box (102). The information of the secondary game version can include the current points acquired by the player, which round it is, how many points they need to qualify for the next round, and so on. The information can also reflect the top progressive jackpot amount. Alternatively, the information of the secondary game can be shown on the main display where the base game is played, on the player tracking display, or on a large display located in signage near the games. In some embodiments, a window can pop up on the main cabinet display, and be used for advertising to potential players to entice the player to play the secondary game and to explain how the secondary game works.

Payouts

As the skilled reader realizes, a wide variety of types of prizes can be won in the championship round which has value to the player, such as a cash prize, credits, player club points, cars, progressive money amount, mystery dollar amount, vacations, jewelry, dinners, sports tickets, and so on. The top prizes can be progressive, which means a small percentage of each entry could be contributed to the progressive prize. For example if the top starting award is $10,000 and $1 dollar of each entry is put towards the top progressive prize, the first player would move the progressive prize from $10,000 to $10,001. This could also be in credits as well so the top prize could be 10,000 credits. Other types of payouts can be free entry into another tournament. Yet other prizes can be free hotel stays, restaurant vouchers, shopping coupons, and so on. Also the prizes could come from sponsors, such as a car from a particular car manufacturer.

In some embodiments, there are Wide-Area Progressives, in which a percentage of entry fees or revenue from the base game is contributed to a progressive jackpot. The more gaming machines that are linked to the progressive jackpot, the larger the progressive jackpot will grow (such as $10 million or more). The gaming machines associated with the Wide-Area Progressive jackpot can even be located in different casinos contributing to the jackpot, thus the term "wide-area" progressive.

In embodiments where the secondary game is not played against other players, the top prize could be won by multiple people at the same time. In order to control how much is paid out, a novel way could be developed where there are a variety of top prizes. Assume, for example, that the top prizes are $100,000, $25,000, $10,000, and $5,000. When one of the prizes is won, the prize is no longer available and the next time the top award is won, the top award will be the next largest prize. Thus, this jackpot system can be thought of as an "elimination jackpot." In the above example, the first winner of the largest prize would get $100,000. Once that prize has been won the next time the player wins the largest prize it is now $25,000. This could also be done in reverse order, where the prizes get larger so to increase interest in winning the larger jackpots. This method of winning a top jackpot could be used on any casino game.

Another way of giving the top prize is as follows. Assume there are 100 different prizes to be won in the championship round. When a lower prize is won, all the prizes move down one position. One example of such a prize structure is shown in FIG. 10. For example if in place #85 the player must get 1100 points to win $500 and in place #84 the player needs 1200 points to get $750, and in place #83 the player needs 1300 points to get $1,000. So if someone wins the #85th place money of $500, the next time someone gets to the #85 position the player will now get $750, and if someone gets to #184 place, they will now get $1,000. Basically if a lesser prize is won, then all prizes above that (or the more valuable prizes) now move down one position. This makes the larger prizes easier to win the longer the secondary game goes on, and can be thought of as a "moving jackpot." However, the top prizes can also be won at any time as well. This method of winning a top jackpot could be used on any casino game.

In some embodiments, in the championship round, the player will always finish in a place, and win credits or prizes. In some embodiments, the player may have to finish in certain places to win prizes and those that don't may not win anything. In some embodiments, the player who loses before the championship round will always win credits or prizes. In some embodiments, a player who loses before the final round may not win anything or if they qualify for a consolation game they still may not win anything.

As was described above, in some embodiments a consolation bonus can be an optional feature which rewards players that lost before reaching the final or championship round. Various types of consolation bonuses can be implemented. For example, as was described above a player can choose one or more boxes from a group of boxes, behind each of which a credit amount is hidden. A wheel can spin, on which there are values on each wheel slice that the player could win. The prize can be a mystery prize, where the player automatically is given a random amount which is the player's consolation prize award. Numerous other ways could be created that are exciting, as can be easily envisioned by those of ordinary skill in the art, but ultimately the player wins a consolation prize. In some consolation bonus rounds the player may not win anything. In some embodiments, the player can win a second chance to stay in the secondary game, or win an entry into another type of secondary game.

In some base games, the player can wager anywhere from 1 cent to 500 cents (or more) on a game (if this was a penny denomination game), that is, the less a player bets, the less the player wins. For example, if the player bets 30 cents on one game and gets 4 cherries across all the reels, the player can get paid 100 credits. If the player would have bet 300 pennies, he would get paid 1,000 credits for the same 4 cherry combination (or ten times more). Thus, if the player plays the secondary game, the more he bets on the base game, the better is the chance that he will reach the point levels to qualify for the next round. While, getting the player to bet more is generally desirable for the casino, it could also potentially be a problem. On many games, the maximum bet is too high for most players, so many will not bet the maximum bet on each game. Thus, it is necessary for a game developer to find a fair formula for setting point levels. For example if a player can bet on 30 lines and 8 credits per line, the maximum bet is 240 credits. Most players would likely bet around 100 credits. A couple of possible solutions for addressing this are as follows.

In some embodiments, the secondary game is only installed on gaming machines where the game's maximum bet is a low enough amount that players typically play the maximum bet, such as a one line, 3 quarter game, where the maximum bet is 75 cents. In some embodiments, the base game is designed specifically for the secondary game where the betting amounts are congruent.

In other embodiments, where the base game has possible high bets per game, various solutions can be implemented. For example, the point levels can be set based on players playing the maximum bet, which encourages higher betting per game. Alternatively, the players can select the number of lines and credits per line upfront and the prizes can be based on their betting level. In another embodiment, the game software can inform the player about what average bet level is needed to get the maximum amount of points. In yet other embodiment, the prizes can be set based on the player only betting one credit on each game. The number of credits won can be divided by the total number of credits bet. For example the player plays 10 credits and wins 100 credits. 10 credits are added to their secondary game total.

While this option makes all play equal, it fails to encourage players to bet more per game. One alternative to remedy this would be to offer extra bonus points, such that the larger they bet the more bonus credits they get. For example, assume that the maximum bet on a game is 100 credits. If the player bets 0 to 10 credits they get no bonus credits, if they bet 11 to 20 credits on the game they get 10 extra points, 21 to 30 they get 20 extra points, and so on. This bonus credits could be awarded for each game they play, or be added only when they win credits on the game. As the skilled reader realizes, this method is based on points awarded on one credit bet (so total credits won divided by total credits bet) then add on the bonus credits.

Further Details on Hardware and Software Configurations

This section discusses the basic setup of the gaming machine, software and system setup (if one is used). In order to implement the secondary game, it is necessary to establish a point level structure and a prize structure. The point levels are based on numerous factors. Some of the factors include: what percentage of players should qualify for each subsequent round; the average payout to the players in the championship round and during the consolation round; maximum and what minimum payouts in the championship and consolation rounds; what percentage of the entry fee will be used for the championship and consolation rounds and what percentage of the entry fee will go back to the casino as revenue. From the base game, it is desirable to know every winning symbol combination, how often each happens, and how much is paid out for each. If the base game has any unique winning features such as bonus games, fever symbols, wild symbols, and so on, it is desirable to know how often they happen and how much is paid out. It is also necessary to know how many lines can be played on the game and how many credits can be wagered on each line. FIG. 11 shows a basic secondary game setup for point level and prize structures.

As was described above, it should be realized that not only slot machines, but also various types of other gaming machines can be used in conjunction with the secondary game, such as a general purpose computer (e.g., a desk top computer, laptop computer, tablet computer, server, work station, main frame, personal digital assistant (PDA), cellular phone, and so on). Further some units may be incorporated into other devices such as a cable or satellite set-top box, a video game system or from various types of hand held devices.

Figure 12:
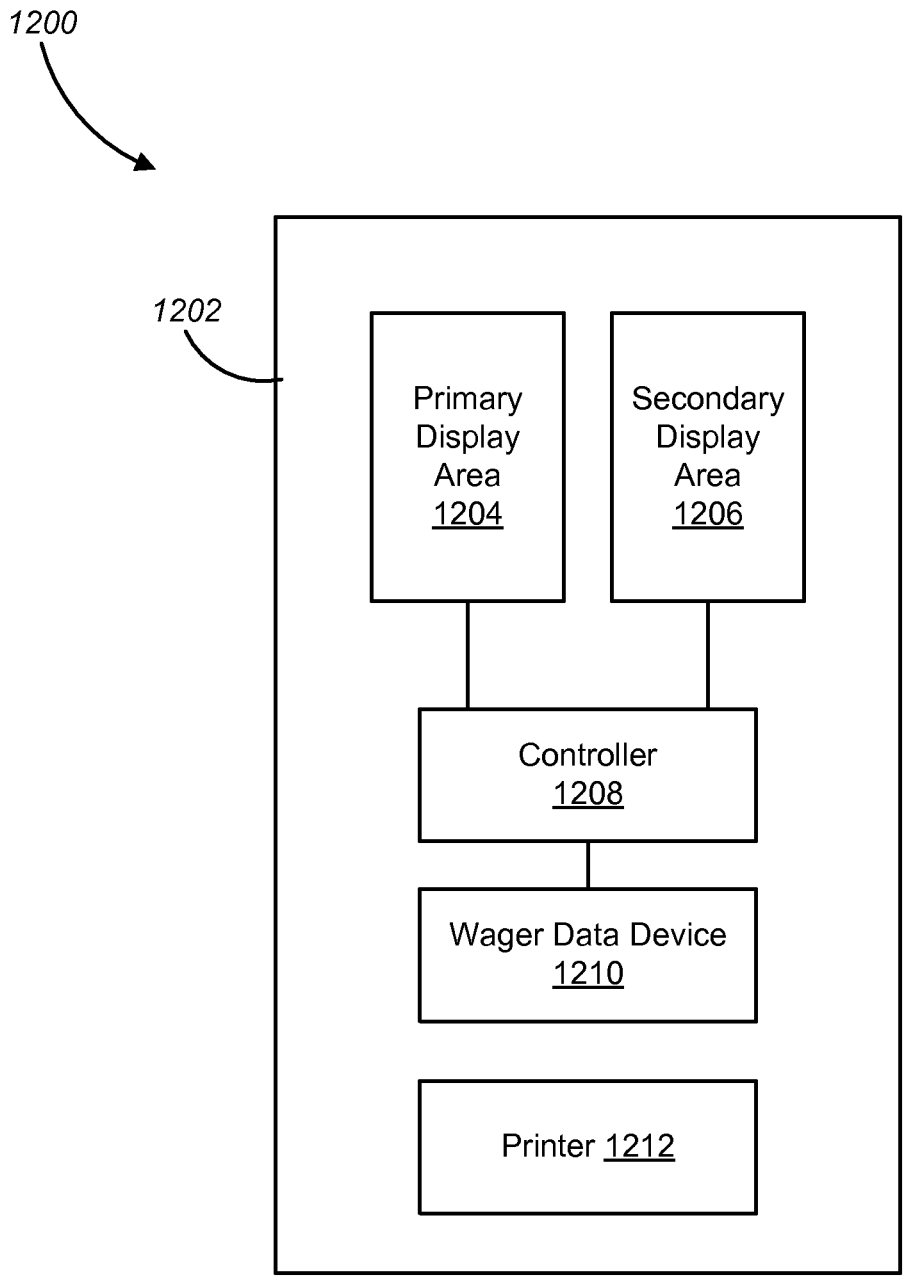
FIG. 12 is a schematic block diagram illustrating some exemplary components of a gaming machine, in accordance with one embodiment of the invention.

One example of a gaming machine (1200) is illustrated in FIG. 12 as a block diagram showing a schematic configuration of the gaming machine (1200). As can be seen in FIG. 12, the gaming machine (1200) includes a housing or cabinet (1202) and one or more wager data devices (1210), which can include a coin slot acceptor, a paper currency acceptor, a ticket reader/printer and a card reader and/or writer which can be used to input a wager to the gaming machine. As used herein, the term "wager" may encompass gaming tokens, coins, paper currency, ticket vouchers, credit or debit cards, and any other object representative of value.

If provided on the gaming machine, a ticket reader/printer (1212) can be used to read and/or print or otherwise encode ticket vouchers. The ticket vouchers can be composed of paper or another printable or encodable material and can have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers could be used, such as bonus ticket vouchers, cash-redemption ticket vouchers, restaurant ticket vouchers, show ticket vouchers, and so on.

The gaming machine can optionally include one or more audio speakers, a coin payout tray, an input panel (not shown) and one or more display units for displaying display data in the primary display area (1204) and secondary display area (1206) relating to the base game and secondary game provided by the gaming machine (1200). The audio speakers may generate audio representing sounds such as the noise of spinning slot machine reels, a dealer's voice, music, announcements or any other audio related to a casino game. The input control panel can have several pushbuttons or touch-sensitive areas that may be pressed by the player to select games, make wagers, make gaming decisions, and so on. The display unit can be a two dimensional display unit such as a color video display unit such as a holographic display, a stereoscopic display, a three dimensional display volume, and so on.

Although one possible control panel has been described above, it should be understood that different buttons can be used in the control panel, and that the particular buttons used can depend on the game or games that could be played on the gaming machine (1200). The control panel described above has been shown to be separate from the display unit(s) displaying the primary display area (1204) and the secondary display area (1206), but it should be understood that the control panel could be generated by the display unit. In that case, each of the buttons of the control panel could be a colored area generated by the display unit, and some type of mechanism may be associated with the display unit to detect when each of the buttons was touched, such as touch sensitive screen.

A controller (1208) coordinates the actions and data transfer between the various components of the gaming machine (1200). In some embodiments, the controller includes a processor and a memory storing instructions for how the secondary game is to be carried out in the various game embodiments described above. In other embodiments, the game instructions are not persistently stored in the memory, but instead the controller (1208) can download the instructions from a remote source, as will be described in further detail below. In some embodiments, the controller (1208) can also interface with controllers in other gaming machines (1200) to enable community gaming scenarios as well as wide-area progressive jackpot systems scenarios, as was described above.

In some networked embodiments, a secondary game server can be provided, which includes a computer, such as a desk top computer, a laptop computer, a work station, a server, a mainframe, and so on. The secondary game server can include a controller that can include a program memory, a microcontroller or microprocessor, a random-access memory (RAM), and an input/output (I/O) circuit, all of which may be interconnected via an address/data bus. A display and one or more input devices can be operatively coupled to the I/O circuit, each of those components being so coupled by either a unidirectional or bidirectional, single-line or multiple-line data link, which may depend on the design of the component that is used. The gaming machine can transmit to the server an indication that the player submitted the requested payment to the gaming machine by, for example, inserting currency, deducting value from a smart card, authorizing a charge to a credit card or debit card, authorizing a deduction form an account, and so on. Additionally or alternatively, the gaming machine (1200) can transmit to the secondary game server information for charging an entry fee to a credit card or debit card for deducting the entry from an account.

Appropriate software can be loaded to the gaming machine (1200). The software can be loaded through a network connection, a floppy disk, a CD-ROM, a DVD, a PC card, smart card, and so on. The software can be loaded through a portable memory device, a multi-media card memory device, a smart media memory device, memory stick memory device, or similar devices. The software can include one or more of an executable file, a configuration file, a data file, a pay table, and so on. The software can also include several seeds for a random number generator. The seeds can be, for example, randomly or pseudo-random generated. The software can be used to configure the controller. The software can be different for different types of gaming machines. Once the software has been loaded onto a gaming machine, the player can use the gaming machine to play a secondary game corresponding to the loaded software.

In some embodiments, the secondary game server, or controller, will try to authenticate the software on the gaming machine prior to enabling the gaming machine to play. If the software cannot be authenticated, the secondary game server, or controller, may not enable the gaming machine. The secondary game server, or controller, may try to prevent players from playing in a secondary game with software that is not from a known or trusted source, and/or the software has been modified.

Other concerns for the casino is that the player leaves in the middle of a secondary game and someone new comes by and takes advantage of the previous play such as acquiring the points earned in the secondary game from the previous player. Various embodiments of the invention prevent this by giving the player a number of choices when they quit. The player can receive a ticket to resume playing in the future or the player can decide not to play this round of the secondary game again and can choose not to resume and receive their consolation prize right away. The secondary game system in either case will reset the points and games to zero for the next player.

The invention can be implemented in digital electronic circuitry, or in computer hardware, firmware, software, or in combinations of them. Apparatus of the invention can be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

To provide for interaction with a user, the invention can be implemented on a computer system having a display device such as a monitor or LCD screen for displaying information to the user. The user can provide input to the computer system through various input devices such as a keyboard and a pointing device, such as a mouse, a trackball, a microphone, a touch-sensitive display, a transducer card reader, a magnetic or paper tape reader, a tablet, a stylus, a voice or handwriting recognizer, or any other well-known input device such as, of course, other computers. The computer system can be programmed to provide a graphical user interface through which computer programs interact with users. A video controller can manage what is displayed on the top box display. The video controller increments and decrements the numbers related to the point totals, games left, and will manage when attract, winning, and game play info video clips will be shown. This same controller, or a separate progressive controller, can be used for the progressive or mystery jackpot amounts.

Finally, the processor optionally can be coupled to a computer or telecommunications network, for example, an Internet network, or an intranet network, using a network connection, through which the processor can receive information from the network, or might output information to the network in the course of performing the above-described method steps. Such information, which is often represented as a sequence of instructions to be executed using the processor, may be received from and outputted to the network, for example, in the form of a computer data signal embodied in a carrier wave. The above-described devices and materials will be familiar to those of skill in the computer hardware and software arts.

It should be noted that the present invention employs various computer-implemented operations involving data stored in computer systems. These operations include, but are not limited to, those requiring physical manipulation of physical quantities. Usually, though not necessarily, these quantities take the form of electrical or magnetic signals capable of being stored, transferred, combined, compared, and otherwise manipulated. The operations described herein that form part of the invention are useful machine operations. The manipulations performed are often referred to in terms, such as, producing, identifying, running, determining, comparing, executing, downloading, or detecting. It is sometimes convenient, principally for reasons of common usage, to refer to these electrical or magnetic signals as bits, values, elements, variables, characters, data, or the like. It should remembered however, that all of these and similar terms are to be associated with the appropriate physical quantities and are merely convenient labels applied to these quantities.

The present invention also relates to a device, system or apparatus for performing the aforementioned operations. The system may be specially constructed for the required purposes, or it may be a general-purpose computer selectively activated or configured by a computer program stored in the computer. The processes presented above are not inherently related to any particular computer or other computing apparatus. In particular, various general-purpose computers may be used with programs written in accordance with the teachings herein, or, alternatively, it may be more convenient to construct a more specialized computer system to perform the required operations.

A number of implementations of the invention have been described. Nevertheless, it will be understood that various modifications may be made without departing from the spirit and scope of the invention. For example, the secondary game can be played without receiving a separate wager, but instead be funded by revenues from the base game. Accordingly, other embodiments are within the scope of the following claims.

The invention claimed is:

1. A gaming apparatus, comprising:

a primary display area operable to display a base game to a player;

a wager data device operable to receive wager data indicative of a wager submitted by the player;

a secondary display area separate from the primary display area and operable to display a parallel secondary game to the player, the parallel secondary game comprising multiple qualification rounds and a final championship round; and a controller operatively coupled to the primary display area, the wager data device, and the secondary display area, the controller comprising a processor and a memory, the controller being operable to:

display results of the base game to the player on the primary display area;

convert credits earned in the base game to game points in the parallel secondary game, while the base game is being played;

display results of the parallel secondary game to the player on the secondary display area while the base game is being played, wherein the results are displayed in relation to predetermined game point levels for each qualification round of the parallel secondary game; and determine, based on the achieved game point levels and the predetermined game point levels for each qualification round of the parallel secondary game, whether to advance the player to a subsequent qualification round of the parallel secondary game or to end the parallel secondary game.

2. The gaming apparatus of claim 1, wherein the controller further is operable to:

display a selection of parallel secondary games to the player on the primary display area; and receive a selection from the player of a parallel secondary game to play.

3. The gaming apparatus of claim 2, wherein displaying the selection of parallel secondary games includes displaying a required entry fee for each of the parallel secondary games, and wherein receiving a selection includes receiving the required entry fee for the selected parallel secondary game by the wager data device.

4. The gaming apparatus of claim 1, wherein a specific predetermined game point level must be reached for the player in each qualification round of the parallel secondary game in order to advance the player to a subsequent qualification round of the parallel secondary game.

5. The gaming apparatus of claim 4, wherein the player has a specific number of base games to play in each qualification round of the parallel secondary game in order to advance the player to a subsequent qualification round of the parallel secondary game.

6. The gaming apparatus of claim 1, wherein game point levels accumulated during the championship round are used to determine a prize to be awarded to the player.

7. The gaming apparatus of claim 6, wherein the prize is funded by a portion of entry fees received from players choosing to play the parallel secondary game, and is independent from wagers received from players for playing the base game.

8. The gaming apparatus of claim 6, wherein the controller further is operable to:

display to the player a current game point level in relation to established game point levels based on the prize level configuration for the championship round.

9. The gaming apparatus of claim 6, wherein the prize is a jackpot, the jackpot being selected from one or more of: progressive top jackpots, fixed jackpots, moving jackpots, elimination jackpots, mystery jackpots, and wide-area progressive jackpots.

10. The gaming apparatus of claim 1, wherein the controller further is operable to award a consolation prize to a player in response to determining not to advance the player to a subsequent qualification round of the parallel secondary game.

11. The gaming apparatus of claim 1, wherein the prize paid out from the parallel secondary game is based on one or more of: a range, and a targeted average pay.

12. The gaming apparatus of claim 1, wherein the gaming apparatus is selected from the group consisting of: video spinning reel slot machines, mechanical spinning reel slot machines, video poker slot machines, video keno slot machines, video blackjack slot machines, live casino table games, Internet casino games, home video games, and handheld games.

13. The gaming apparatus of claim 1, wherein converting credits earned in the base game to game points in the parallel secondary game is done in accordance with a predetermined formula.

14. The gaming apparatus of claim 1, wherein the controller is operable to communicate with controllers located in other gaming apparatuses to enable one or more of: community gaming versions, tournament gaming versions, team gaming versions, and player club gaming versions of the parallel secondary game.

15. The gaming apparatus of claim 1, wherein the gaming apparatus is operatively connected to one or more of: a player tracking and accounting system, a game server, and a central monitoring system.

16. The gaming apparatus of claim 15, wherein the controller is operable to download one or more of the base game and the parallel secondary game from the game server prior to starting the base game or the parallel secondary game.

17. The gaming apparatus of claim 15, wherein the controller further is operable to:

in response to a player ending the parallel secondary game prior to reaching a championship or consolation round, store the player's accumulated game points for the parallel secondary game in the player tracking and accounting system so that the player can resume the parallel secondary game at the point where the parallel secondary game was ended at a later time.

18. A computer-implemented gaming method performed by a gaming apparatus, comprising:

receiving, by a wager data device of the gaming apparatus, wager data indicative of a wager submitted by a player;

displaying results of a base game to the player on a primary display area of the gaming apparatus;

converting, by a controller of the gaming apparatus, credits earned in the base game to game points in a parallel secondary game while the base game is being played, the parallel secondary game comprising multiple qualification rounds and a final championship round;

displaying results of the parallel secondary game to the player on a secondary display area of the gaming apparatus, the second display area being separate from the primary display area while the base game is being played, wherein the results are displayed in relation to predetermined game point levels for each qualification round of the parallel secondary game; and determining, by the controller, based on the achieved game point levels and the predetermined game point levels for each qualification round of the parallel secondary game, whether to advance the player to a subsequent qualification round of the parallel secondary game or to end the secondary game.

19. The gaming method of claim 18, further comprising:

displaying a selection of parallel secondary games to the player on the primary display area; and receiving a selection from the player of a parallel secondary game to play.

20. The gaming method of claim 19, wherein displaying the selection of parallel secondary games includes displaying a required entry fee for each of the parallel secondary games, and wherein receiving a selection includes receiving the required entry fee for the selected parallel secondary game by the wager data device.

21. The gaming method of claim 18, wherein a specific predetermined game point level must be reached for the player in each qualification round of the parallel secondary game in order to advance the player to a subsequent qualification round of the parallel secondary game.

22. The gaming method of claim 21, wherein a specific number of base games must be played by the player in each qualification round of the parallel secondary game in order to advance the player to a subsequent qualification round of the parallel secondary game.

23. The gaming method of claim 18, wherein game point levels accumulated during the championship round are used to determine a prize to be awarded to the player.

24. The gaming method of claim 23, wherein the prize is funded by entry fees received from players choosing to play the parallel secondary game, and is independent from wagers received from players for playing the base game.

25. The gaming method of claim 24, further comprising:

displaying to the player a current game point level in relation to established game point levels based on the prize level configuration for the championship round.

26. The gaming method of claim 25, wherein the prize is a jackpot, the jackpot being selected from one or more of: progressive top jackpots, fixed jackpots, moving jackpots, elimination jackpots, mystery jackpots, and wide-area progressive jackpots.

27. The gaming method of claim 18, further comprising:

awarding a consolation prize to a player in response to determining not to advance the player to a subsequent qualification round of the parallel secondary game.

28. The gaming method of claim 18, wherein any prize paid out from the parallel secondary game is based on one or more of: a range, and a targeted average pay.

29. The gaming method of claim 18, wherein the method is performed on a gaming apparatus selected from the group consisting of: video spinning reel slot machines, mechanical spinning reel slot machines, video poker slot machines, video keno slot machines, video blackjack slot machines, live casino table games, Internet casino games, home video games, and handheld games.

30. The gaming method of claim 18, wherein converting credits earned in the base game to game points in the parallel secondary game is done in accordance with a predetermined formula.

31. The gaming method of claim 18, further comprising:

communicating with other gaming apparatuses to enable one or more of: community gaming versions, tournament gaming versions, team gaming versions, and player club gaming versions of the parallel secondary game.

32. The gaming method of claim 31, further comprising:

downloading one or more of the base game and the parallel secondary game from the game server prior to starting the base game or the parallel secondary game.

33. The gaming method of claim 31, further comprising:

in response to a player ending the parallel secondary game prior to reaching a championship or consolation round, storing the player's accumulated game points for the parallel secondary game in a player tracking and accounting system so that the player can resume the parallel secondary game at the point where the parallel secondary game was ended at a later time.

* * * * *